United States Patent [19]

Price et al.

[11] Patent Number: 4,712,842

[45] Date of Patent: Dec. 15, 1987

[54] MOVABLE COMPUTER WORK PROCESSING SYSTEM

[75] Inventors: Macy J. Price, Golden; Mack E. Johnson, Littleton; Norman J. Acker, Denver, all of Colo.

[73] Assignee: Engineered Data Products, Inc., Broomfield, Colo.

[21] Appl. No.: 928,751

[22] Filed: Nov. 7, 1986

[51] Int. Cl.[4] ..... A47B 21/03

[52] U.S. Cl. ..... 312/196; 312/208; 312/233; 312/325

[58] Field of Search ..... 312/196, 208, 231, 233, 312/138 R, 7.2, 302, 304, 322, 325, 194

[56] References Cited

U.S. PATENT DOCUMENTS

| | | | |
|---|---|---|---|
| 536,709 | 4/1895 | Talman | 312/233 |
| 549,347 | 11/1895 | Clark | 312/233 |
| 972,923 | 10/1910 | Ritter | 312/208 |
| 1,652,774 | 12/1927 | Fraser et al. | 312/233 |
| 1,778,163 | 10/1930 | Moore | 312/325 |
| 1,996,767 | 4/1935 | Hunter | 312/233 |
| 3,367,290 | 2/1968 | Barecki | 312/194 |
| 3,702,209 | 11/1972 | Moore | 312/196 |
| 3,801,175 | 4/1974 | Giulie . | |
| 3,865,445 | 2/1975 | Dean et al. . | |
| 3,936,201 | 2/1976 | Kenney et al. . | |
| 3,980,360 | 9/1976 | Wright et al. . | |
| 4,056,296 | 11/1977 | Hedstrom et al. . | |
| 4,073,556 | 2/1978 | Wilson, Jr. . | |
| 4,171,854 | 10/1979 | Hedstrom et al. . | |
| 4,314,734 | 2/1982 | Grunert | 312/322 |
| 4,428,631 | 1/1984 | Cope et al. . | |
| 4,483,572 | 11/1984 | Story | 312/196 |

FOREIGN PATENT DOCUMENTS

| | | |
|---|---|---|
| 1222730 | 10/1967 | United Kingdom . |
| 1408701 | 10/1976 | United Kingdom . |
| 1462266 | 1/1977 | United Kingdom . |

*Primary Examiner*—Victor N. Sakran

*Attorney, Agent, or Firm*—Bruce G. Klaas; Joseph J. Kelly

[57] ABSTRACT

A movable computer work processing system wherein a movable computer work station unit having a plurality of supporting surfaces in a housing thereof for supporting components of a computer work processing system is adapted to be moved over a desk. A slidably and pivotally mounted shelf means has a support surface for supporting components of a computer work processing system and is slidably moved out of the housing and pivoted until a portion thereof contacts the desk. The housing is provided with a slidably pivotally mounted front door means which is in a closed position when the housing is being moved and an open position when the computer work processing system is being used. Also, the front door means may be moved to a partially opened position to block off glare from overhead lighting.

14 Claims, 21 Drawing Figures

Fig. 1.
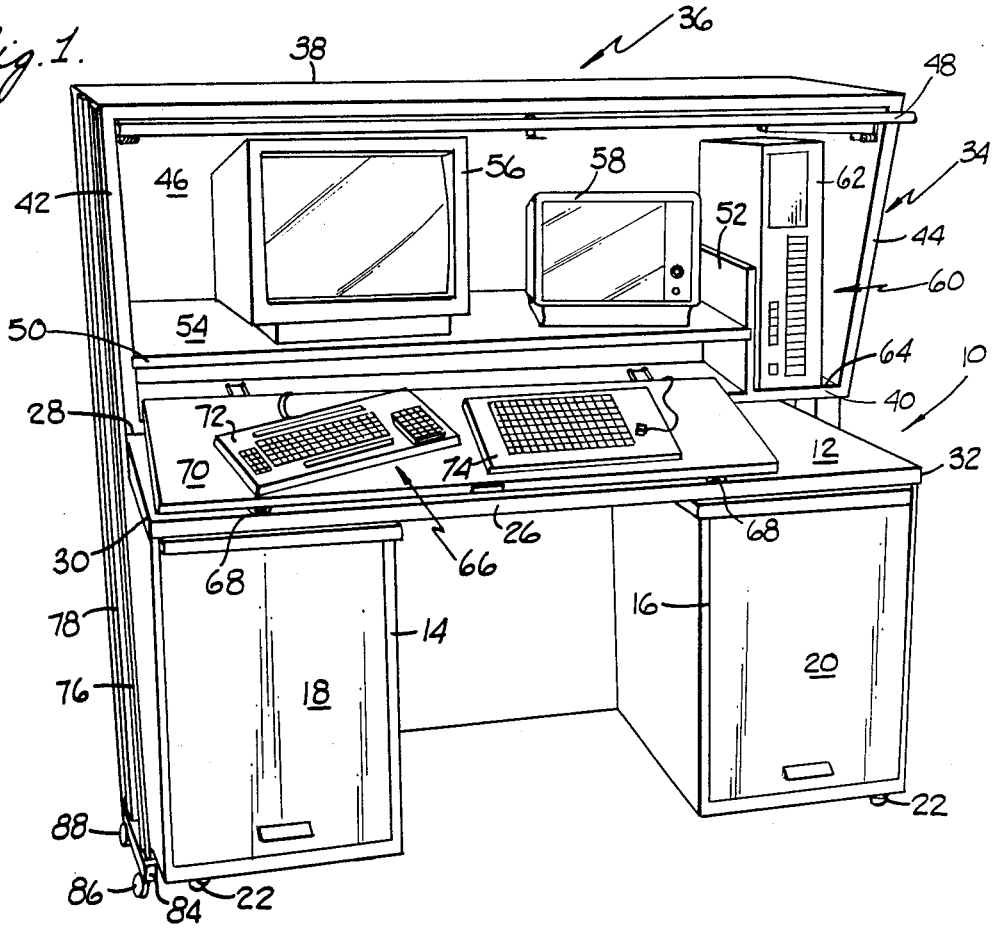
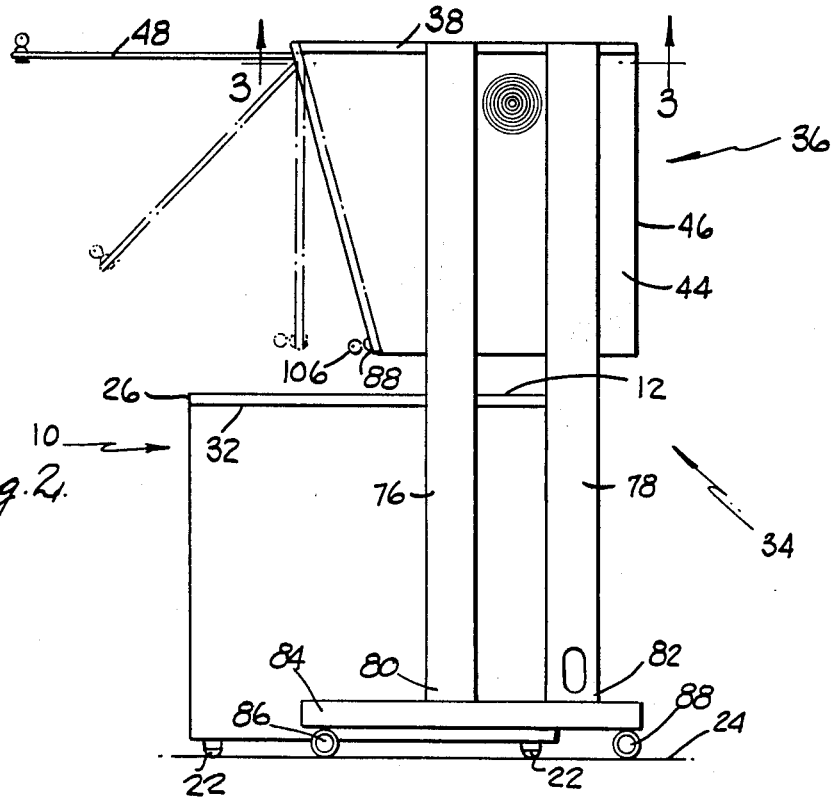
Fig. 2.

Fig. 5.
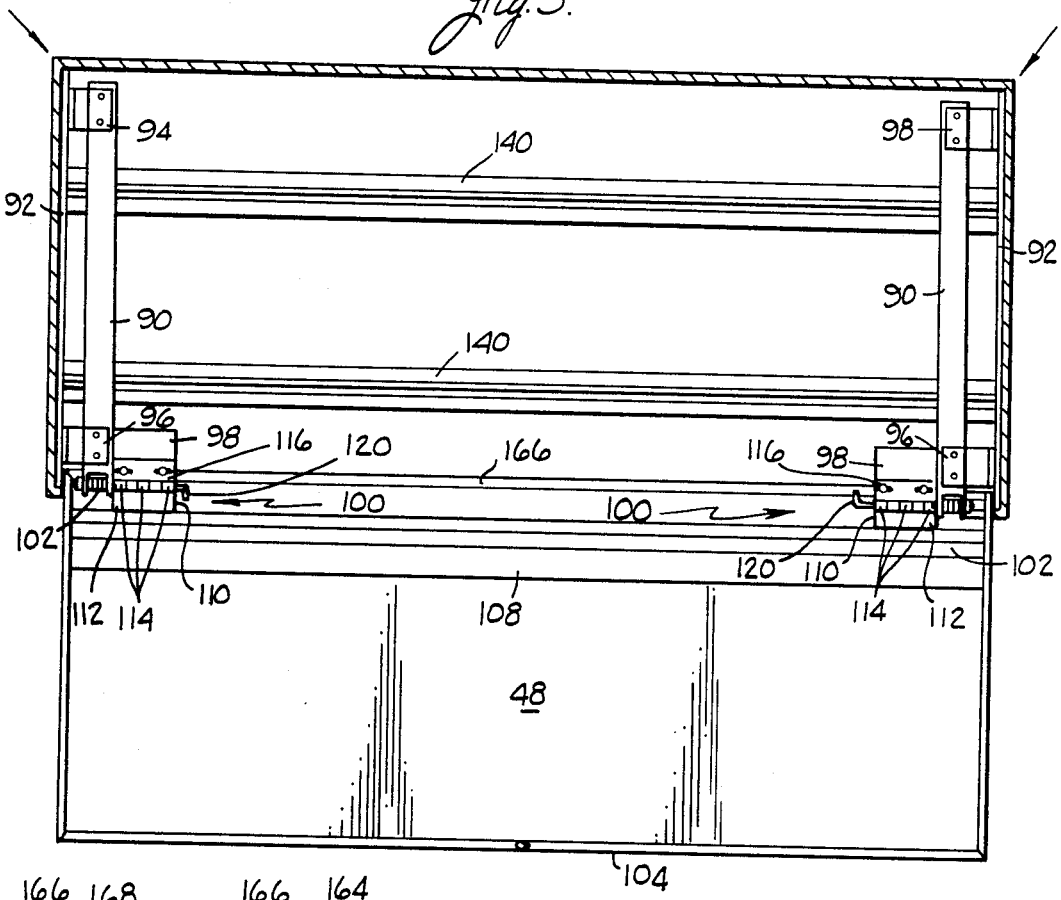
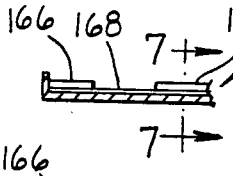
Fig. 6.
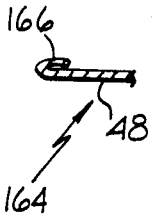
Fig. 7.
Fig. 8.
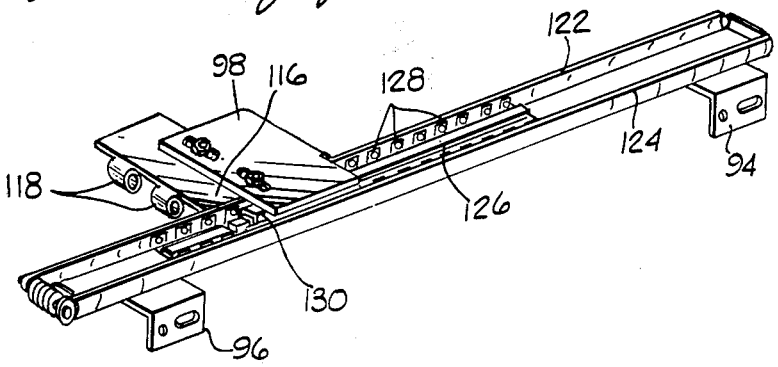

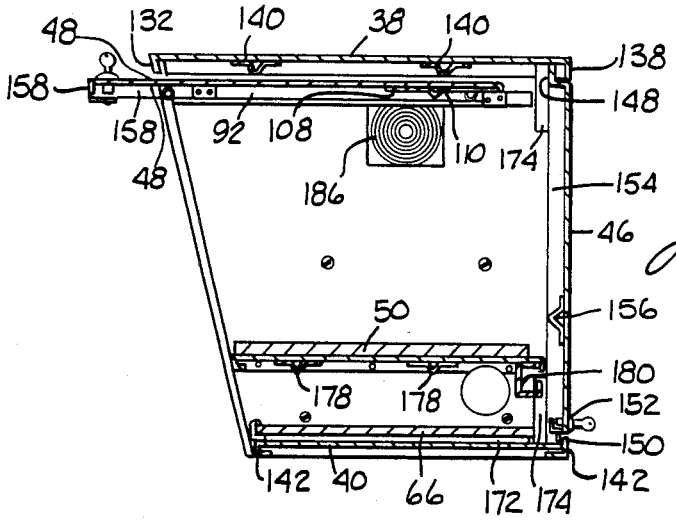
Fig. 10
Fig. 11
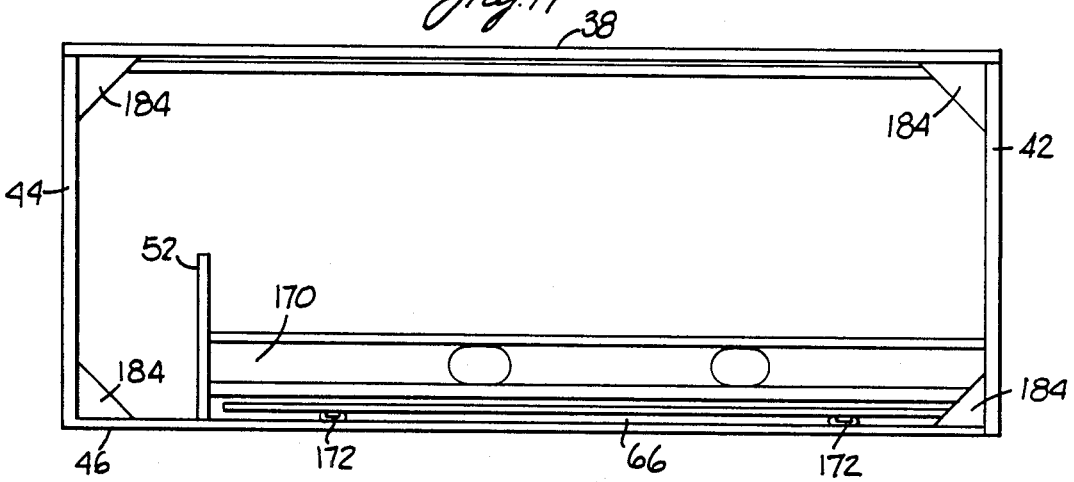
Fig. 9
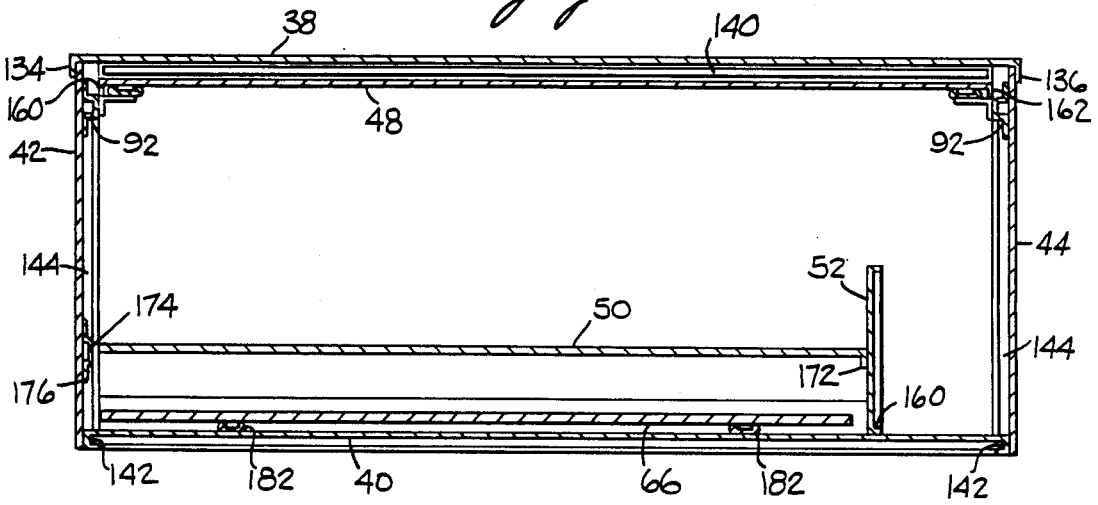

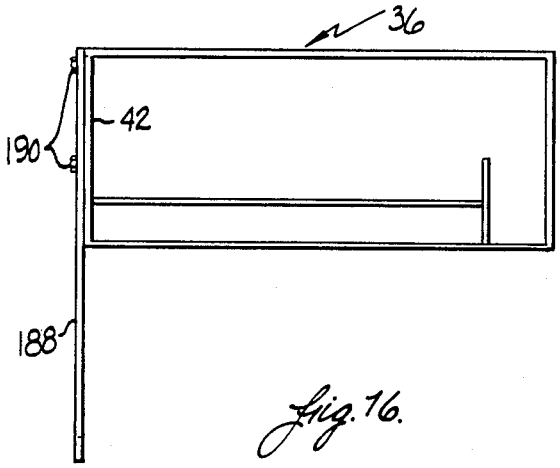
Fig. 16.
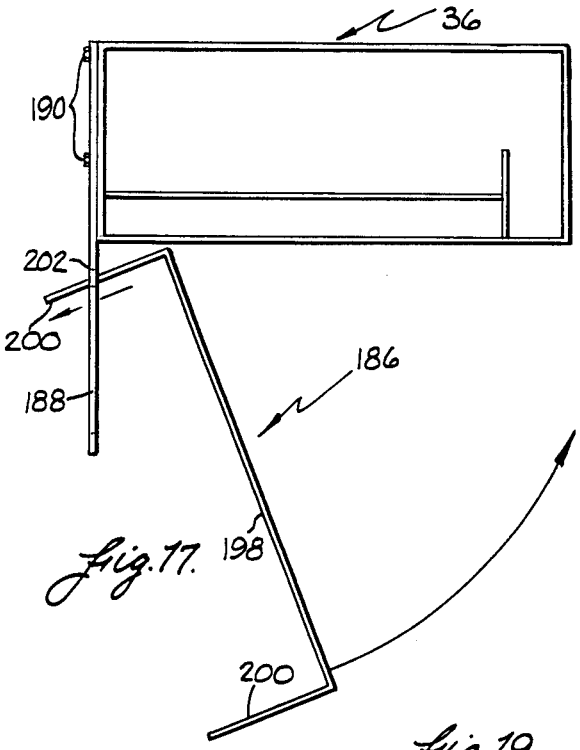
Fig. 17.
Fig. 18.
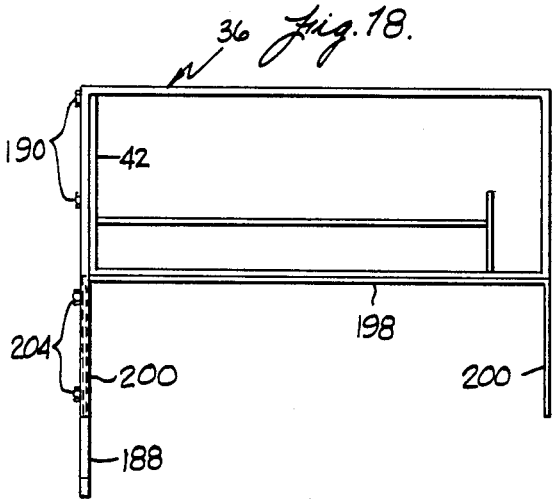
Fig. 19.
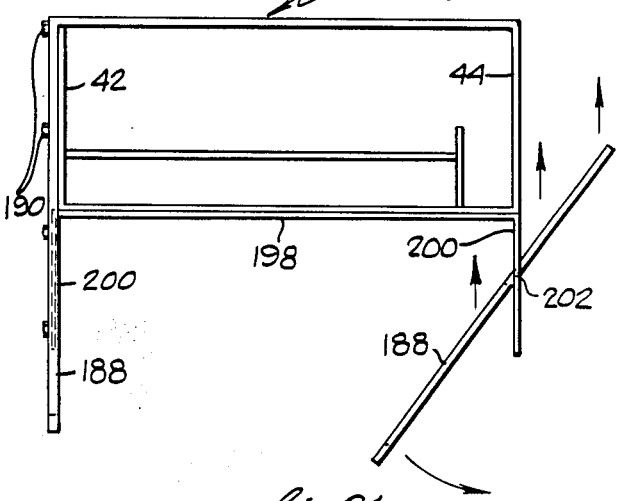
Fig. 20.
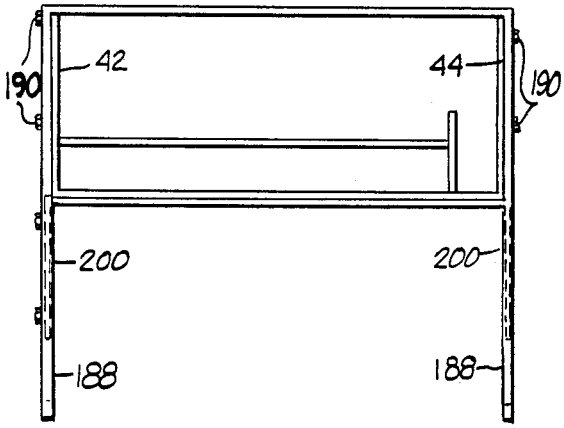
Fig. 21.
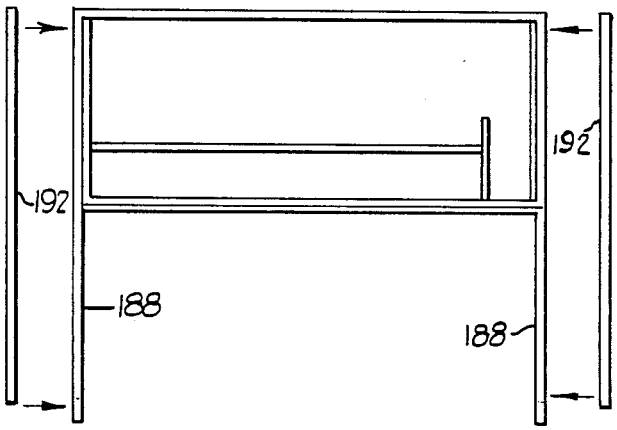

MOVABLE COMPUTER WORK PROCESSING SYSTEM

FIELD OF THE INVENTION

This invention relates generally to apparatus which cooperates with an existing work station, such as a desk, in providing a personal computer work station and more particularly for providing a personal computer aided design work station.

BACKGROUND OF THE INVENTION

One of the more recent and rapidly growing technological advances lies in the field of computer aided design apparatus. This apparatus comprises several components that necessarily must be located in close relationship in order for the efficient use of the apparatus. In most instances, this presents problems since the ordinary work stations, such as a desk, are not designed to accommodate all of the required components. It is also desirable that apparatus of this nature be available for use at more than one location. This presents a problem in moving all of the required components from one location to another location. Economic considerations prevent the provision of all the required components at a plurality of locations. Therefore, there exists a need for providing some solution to the foregoing problems.

BRIEF DESCRIPTION OF THE INVENTION

This invention provides a computer work processing system wherein a movable computer work station unit cooperates with an existing work station, such as a desk, to provide apparatus for locating all of the required components at one location for convenient personal use. The movable computer work station unit has a plurality of support surfaces for supporting various components of a computer work processing system which support surfaces are located in a housing having a bottom wall portion, a top wall portion, a removable back wall portion, two side wall portions and a front wall portion comprising a slidably and pivotally mounted front door means. Support means are provided for supporting the movable computer work station unit so that the bottom wall thereof is spaced a distance above the top panel of the desk when it is moved to a position over a portion of the top panel of the desk. When the front door means is moved to an open position, the computer work station has a slidable and pivotal shelf means that may be pulled out of the housing and pivoted to a position wherein a portion thereof is supported on the top panel of the desk. The slidable and pivotal shelf means provides a surface for supporting various components of a computer work processing system which may remain thereon when the slidable and pivotal shelf means is moved to a closed position within the housing. The support means are provided with swivelly mounted rollers so that the movable computer work station unit can be moved to any desired location.

It is an object of this invention to provide a movable computer work station unit having support surfaces for supporting all the required components of a computer work processing system in a usable arrangement and which can be conveniently moved from on location to another location.

Additional objects, advantages, and novel features of the invention are set forth in the accompanying drawings, the detailed description and the claims.

BRIEF DESCRIPTION OF THE DRAWING

An illustrative and presently preferred embodiment of the invention is shown by the accompanying drawings in which:

FIG. 1 is a pictorial view of a preferred and illustrative embodiment of the invention in position over a desk;

FIG. 2 is a side elevational view illustrating the movement of the front door means;

FIGS. 3–5 are cross-sectional views only of the housing taken on the line 3—3 of FIG. 2 and illustrating the front door means in three different locations;

FIG. 6 is a cross-sectional view of an side portion of the front door means;

FIG. 7 is a cross-sectional view taken on the line 7—7 of FIG. 6;

FIG. 8 is a pictorial view of the slide guide and half of the pivot hinge used in the preferred embodiment with the front door means removed;

FIG. 9 is a cross-sectional view of the housing taken on the lines 9—9 of FIG. 3;

FIG. 10 is a cross-sectional view of the housing taken on line 10—10 of FIG. 3;

FIG. 11 is an back elevational view with the back wall portion removed.

FIGS. 16–21 illustrate the method for assembling the support legs to the housing.

DETAILED DESCRIPTION OF THE INVENTION

Figure 3:
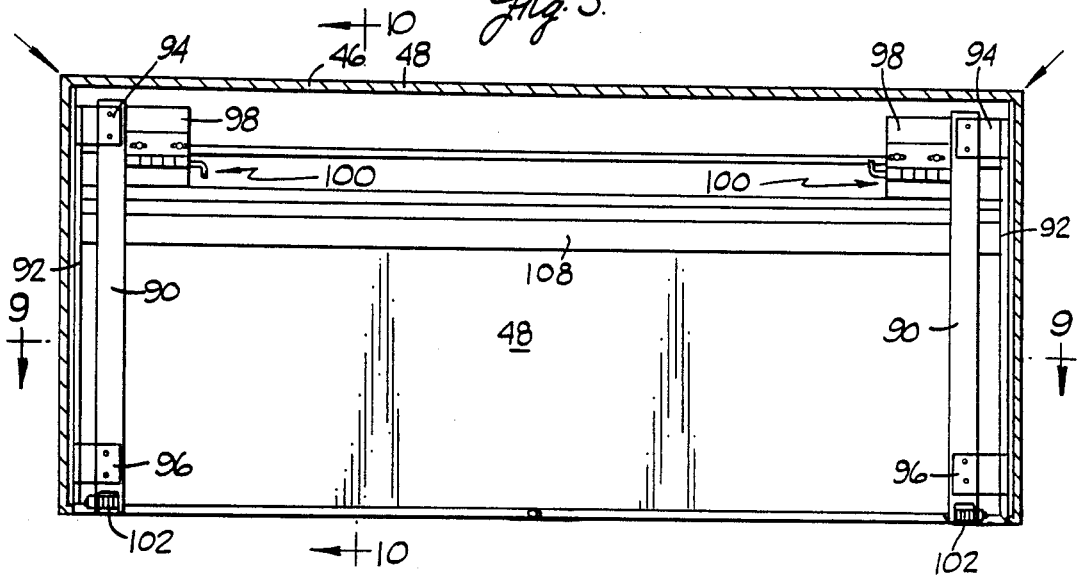

In FIGS. 1 and 2, there is illustrated the apparatus and system of a preferred embodiment of the invention comprising a desk-type work station means 10 having an upper generally flat top panel means 12, a pair of spaced apart pedestal means 14 and 16 each of which has a slidable drawer cover means 18 and 20 and support means 22 for supporting the desk-type work station means 10 on a floor 24 (FIG. 2) of a building to provide a fixed generally horizontal supporting surface area. The upper top panel means 12 has a front edge portion 26, a back edge portion 28 and side edge portions 30 and 32.

Also, in FIGS. 1 and 2, there is illustrated a movable computer work station unit 34 which, in the preferred embodiment of the invention, is used to support the various components of a computer aided design apparatus. The movable computer work station unit 34 comprises a housing 36 having a top wall portion 38, a bottom wall portion 40, a pair of opposed side wall portions 42 and 44, a back wall portion 46 and a front wall portion comprising a slidably and pivotally mounted front door means 48. A fixedly mounted shelf means 50 extends between the side wall portion 42 and a fixedly mounted support panel 52. The fixedly mounted shelf means 50 has a surface portion 54 on which various components of the computer work processing system, such as a graphic monitor for design illustration 56 and a graphic monitor for dimensional illustration 58, may be supported. The fixedly mounted support panel 52 and the side wall portion 44 cooperate to form a compartment 60 so that a central processing unit 62 may be supported on the surface 64 of the bottom wall portion. A slidably and pivotally mounted shelf means 66 is mounted on the bottom wall portion 40 so that it can be moved into the housing 36 to a position above a portion of the bottom wall portion 40 or moved out of the housing and pivoted toward the upper top panel means 12 to be supported thereon by its support feet 68. The slidably and pivotally mounted shelf means 66 has a surface 70 on which various components of the work processing system, such as a keyboard 72 and a digitizer 74, may be supported. The fixedly mounted shelf means 50 is spaced a sufficient distance above the surface 70, when the slidably and pivotally mounted shelf means 66 is located within the housing 36, so that the keyboard 72 and digitizer 74 may remain on the surface 70. A pair of support legs 76 and 78 are secured to each of the side wall portions 42 and 44 and the bottom portions 80 and 82 thereof are secured to a base member 84. A pair of swivelly mounted rollers 86 and 88 are mounted in the base member 84.

In operation, a movable computer work station unit 34 having all the components of a computer aided design apparatus contained therein and with the slidably and pivotally mounted front door means 48 in a closed and locked position is moved over the floor 24 and positioned with the housing 36 thereof located above a portion of the upper top panel means 12 of the desk-type work station means 10. As illustrated in FIG. 2, the bottom wall portion 40 has a width less than the width of the top wall portion 38 so that the front edge portion 88 of the bottom wall portion is located about half way between the front edge portion 26 and the back edge portion 28 of the upper top panel means 12. Also, the bottom wall portion 40 is spaced above the upper top panel means 12 so that conventional items, such as a desk calender, a stapler or other similar type articles, do not have to be removed when the movable computer work station unit 34 is moved into position over the desk-type work station means 10. Also, the front half of the upper top panel means 12 is available for conventional use.

When it is desired to use the various components of the work processing system, the front door means 48 is unlocked and pivoted to a position where it is parallel with the top wall portion 38 and then is slidably moved into the housing 36 using the slide guide means and pivot means described below. The slidably and pivotally mounted shelf means 66 is then slidably moved out of the housing 36 to an open position and then pivoted toward the upper top panel means 12 until the support feet 68 are in contact therewith. The electrical connections are made and the computer work processing system is ready for operation.

Figure 4:
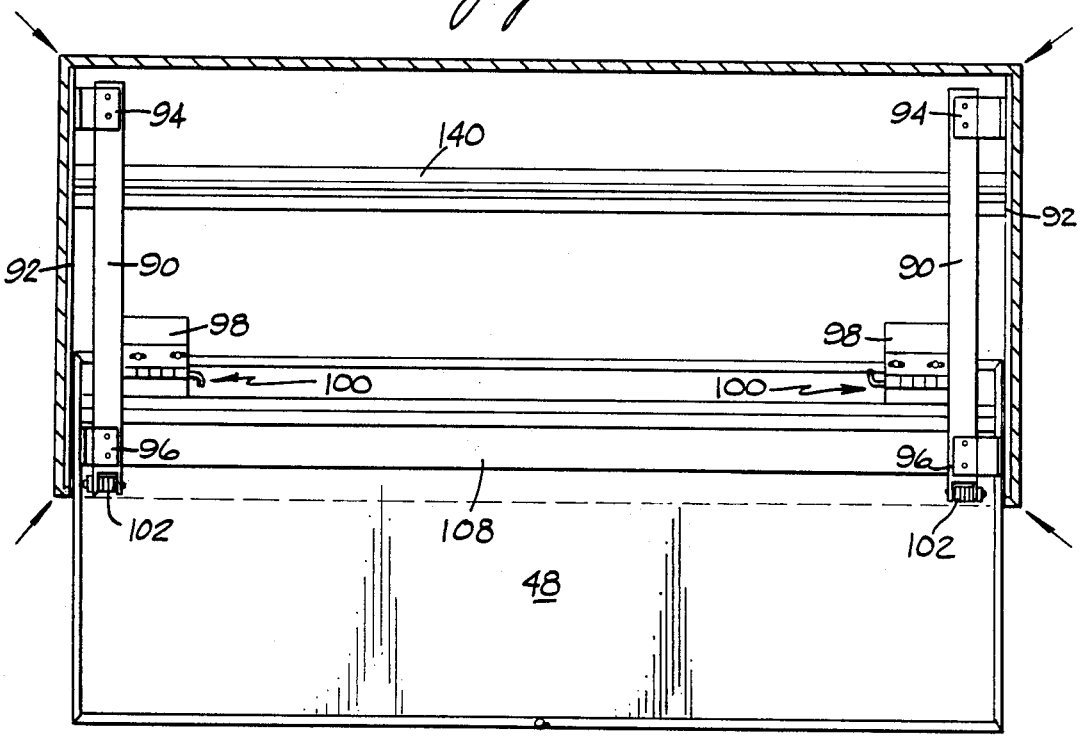
Figure 12:
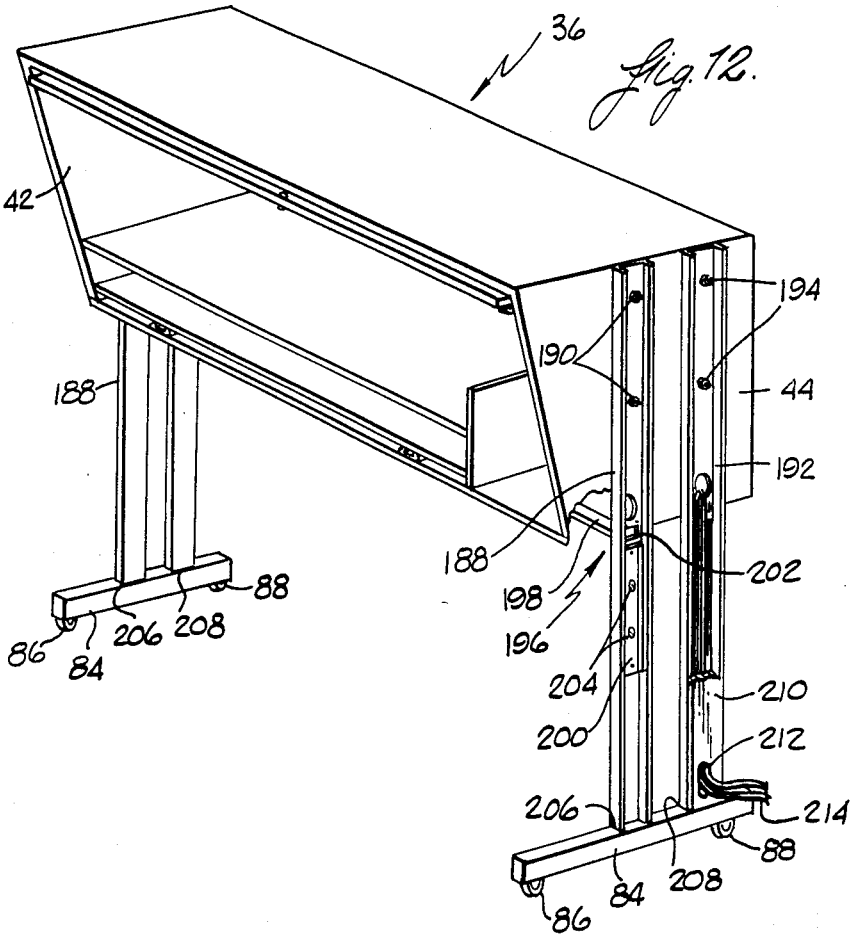
FIG. 12 is a pictorial view particularly illustrating the support structure.
Figure 13:
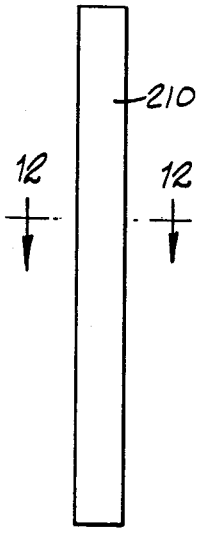
FIGS. 13–15 illustrate the support legs.
Figure 14:
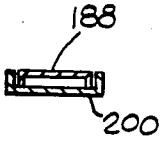
Figure 15:
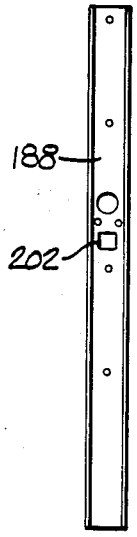

FIGS. 3–5 illustrate three positions of the front door means 48 which is mounted by suitable means, more specifically described below in relation to FIG. 8, for sliding movement over a slide guide supporting member 90. A channel means 92 is secured to each side wall portion 42 and 44 to provide a reinforcement therefor with the channel means thereof opening toward each side wall 42 and 44. A pair of L-shaped flange members 94 and 96 are used to secure each slide guide supporting member 90 to the channel means 92. A support plate 98 is mounted for sliding movement over the slide guide supporting member 90. The front door means 48 is pivotally connected to the support plates 98 by conventional hinge means 100. In FIG. 3, the front door means 48 is completely within the housing 36 and is supported in a position parallel to the top wall portion 38 by the hinge means 100 and a roller support member 102 rotatably mounted on the front portion of each slide guide supporting member 90. In FIG. 4, the front door means 48 has been moved partially out of the housing 36 and is still supported in a position parallel to the top wall portion 38 by the hinges 100 and the roller support members 102. In this position, the front door means 48 blocks off glare from any overhead lighting system so that the components on the fixedly mounted shelf means 50 may be readily observed. In FIG. 5, the front door means 48 is in a fully opened position out of the housing 36 and it is necessary to apply an upwardly directed force to the edge portion 104 to hold the front door means 48 parallel to the top wall portion 38. As the upwardly directed force is gradually decreased, the front door means 48 will pivot around the hinge means 100 until it reaches a position where it is perpendicular to the top wall portion 38. An inwardly directed force is then applied to the front door means 48 to move it toward the housing. When the front door means 48 reaches the closed position illustrated in FIG. 2, the locking means 106 are rotated to lock the front door means 48 in the closed position.

The means for providing the sliding movement of the front door means 48 are described in relation to FIGS. 5 and 6. The front door means 48 has a strengthening rib 108 secured thereto by welding which strengthening rib 108 has a cut-out portion 110 so that a hinge leaf 112 having knuckles 114 may be positioned therein and secured to the front door means 48 by welding. Another hinge leaf 116 having knuckles 118 is secured to the support plate 98 so that the knuckles 114 and 118 are aligned. A hinge pin 120 is inserted through the aligned knuckles 114 and 118 so as to form the hinge means 100. The slide guide supporting member 90 has a pair of internal side portions 122 and 124 having arcuately shaped facing surfaces. A slide guide 126 is positioned between the side portions 122 and 124 and has bearings 128 in contact with the arcuate surfaces of the side portions 122 and 124. A U-shaped slide bar 130 is secured to the support plate 98 and extends into the slide guide 126 so that the leg portions thereof are in contact with the bearings 128. When a force is applied to the front door means 48, the U-shaped slide bar 130 will move over the slide guide 126 in the direction of the force and the frictional contact of the legs of the slide bar 130 on the bearings 128 will rotate the bearings 128 and move the slide guide 126 over the slide guide supporting member 90 in the direction of the force.

A more detailed description of the construction of the housing 36 is illustrated in FIGS. 9–11. The top wall portion 38 comprises a generally planar sheet of metal having a depending flange 132 along a front edge portion, depending flanges 134 and 136 along opposite side wall portions and a depending channel portion 138 along its back edge portion. Two strengthening ribs 140 extend in a lengthwise direction and are secured to the top wall portion by welding. The bottom wall portion 40 comprises a generally planar sheet of metal having an integral channel means 142 extending around the perimeter thereof. Each of the side portions 42 and 44 comprises a generally planar sheet of metal having a flange portion 144 along the back edge portion and a similar flange portion along the front edge portion (not shown). As described above, the channel means 92 is secured to each side wall portion 42 and 44. The back wall portion 46 comprises a generally planar sheet of metal having a lip portion 148 adapted to fit inside of the channel portion 138 and a channel portion 150 adapted to be supported on the bottom wall 40. The back wall 46 can be removed from the housing 36 by lifting and pivoting around the tip portion 148. Locking means 152 are provided to secure the back wall portion 46 to the housing 36. The back wall portion 46 also has a flange portion 154 along each of its side edge portions and a strengthening rib 156 extending in a lengthwise direction and secured thereto by welding. The front door means 48 comprises a generally planar sheet of metal having a depending flange portion 158 along its front edge portion and depending flange portions 160 and 162 along its side edge portions and locking means 106 attached thereto. As illustrated in FIGS. 6 and 7, the back edge portion 164 is formed by bending back over the front door means 48 a strip 166 thereof. A cut-out 168 is provided adjacent each side edge portion to accommodate the leaves 112 and 116 of the hinge means 100. The support panel 52 comprises a generally planar sheet of metal having a flange portion 170 extending around its perimeter and a portion of which is used to secure the support panel 52 to the bottom wall 40 by welding. The shelf means 50 comprises a generally planar sheet of metal and has a flange portion 172 which is secured to the support panel 52 by fastening means. At its other end 174, the shelf means 50 is secured to a member 176 by fastening means, and the member 166 is secured to the side wall portion 42 by welding. Lengthwise extending strengthening ribs 178 are also secured to the shelf means 50 by welding. A channel member 180 is secured to the shelf means 50 by welding, and is used to support electrical wire and cable associated with the various electrical components of the computer work processing system. The slidably and pivotally mounted shelf 66 is provided with means 182 corresponding in structure to the means used for slidably and pivotally mounting the front door means 48 with the slide guide supporting member 90 attached to the bottom wall portion 40. Reinforcing gussets 184 are used to reinforce the corners at the back of the housing 36 and are secured to adjacent wall portions by welding. A fan 186 is secured to each side wall portion 42 and 44 to provide ventilation. The housing 36 is formed by securing adjacent surfaces together by welding.

The support structure for supporting the housing 36 so that it can be moved over a floor 24 is illustrated in FIGS. 12–15. The leg 76 of FIG. 2 comprises an elongated U-shaped metallic channel means 188 which is secured to each side wall portion 42 and 44 so that the U-shaped channel opens outwardly by suitable means, such as the nuts and bolts 190. The leg 78 of FIG. 2 comprises an elongated U-shaped metallic channel means 192 which is secured to each side wall portion 42 and 44 at a distance spaced from the elongated U-shaped metallic channel means 188 and with its U-shaped channel facing outwardly by suitable means, such as the nuts and bolts 194. A U-shaped reinforcing member 196 comprising an elongated central portion 198 has a perpendicularly extending leg 200 at each end thereof. The central portion 188 is a tube and the legs 190 are U-shaped metallic channel portions. The end portions of the central portion 198 extend through openings 202 in the elongated U-shaped channel means 188 and the legs 200 are secured thereto by suitable means, such as the nuts and bolts 204, so that its U-shaped channel opens outwardly. The end portion 206 of each of the elongated U-shaped metallic channel means 188 and the end portion 208 of each of the elongated U-shaped metallic means 192 are secured to the base member 84 by welding. A pair of swivelly mounted rollers 86 and 88 are mounted in each base member 84. A cover member 210, illustrated in FIG. 13 and comprising a U-shaped metallic channel member, is dimensioned to fit over each of the elongated U-shaped metallic channel members 188 and 192. The cover members 210 for the elongated U-shaped metallic channel means 192 is provided with a cut-out 212 so that electrical wire and cable 214 located between the elongated U-shaped metallic member 192 and the cover member 210 may pass therethrough.

The elongated U-shaped metallic channel means 188 and 192 are secured to the housing 36, as illustrated in FIGS. 16–21. A housing 36 is placed on a surface with its back wall portion in contact with the surface. One of the elongated U-shaped metallic channel means 188 is then secured to one side portion 42 using nuts and bolts 190. One leg 200 of the reinforcing member 196 is moved through the opening 202 and pivoted until the central portion 198 is adjacent to the bottom wall portion 40, FIGS. 15 and 16. Nuts and bolts 204 are then used to secure the leg 200 to the first U-shaped metallic channel means 188. As illustrated in FIGS. 17 and 18, the other elongated U-shaped metallic channel means 188 is passed over the leg 200 using the opening 202 and pivoted into position so that nuts and bolts 204 may secure the leg 200 thereto with the upper portion thereof secured to the side wall portion 44 by nuts and bolts 200. Elongated U-shaped channel means 192 are then secured to side wall portions 42 and 44 by nuts and bolts 194, as generally illustrated in FIG. 21. The base members 84 are then secured to the elongated U-shaped metallic channel means 188 and 202 (not shown).

It is contemplated that the inventive concepts herein described may be variously otherwise embodied and it is intended that the appended claims be construed to include alternative embodiments of the invention except insofar as limited by the prior art.

What is claimed is:

1. A computer work processing system comprising:

a generally flat top panel means for providing support means for work product material, said panel means having a front edge portion, a back edge portion and left and right side edge portions;

a pair of laterally spaced pedestal means for supporting said top panel means a distance above a fixed generally horizontal supporting surface area;

a movable computer work station unit having a plurality of support surfaces for supporting various components of a computer work processing system;

said support surfaces located in a housing having a bottom wall portion, a top wall portion, a back wall portion, two side wall portions and a front wall portion;

support means for supporting said bottom wall portion of said movable computer work station unit at a distance above said top panel means when said movable computer work station unit is moved to a position over a portion of said top panel means including said back edge portion;

said support means comprising a pair of spaced apart support members having upwardly extending support sections secured thereto;

each of said support sections having an upper portion secured to one of said side wall portions of said housing and a middle portion having at least a portion thereof opposite to either said left or right side edge portions;

said at least portions being spaced apart a distance greater than the distance between said left and right side edge portions;

roller means on each of said support members for permitting movement of said movable computer work station unit over said top panel means to said position over a portion of said top panel means including said back edge portion;

a slidable shelf means mounted in said housing for permitting movement of said slidable shelf means between a closed storage position in said housing and an open position with a portion thereof supported on said top panel;

pivot means connecting said slidable shelf means to said housing for permitting pivotal movement of said slidable shelf means toward said top panel means and into contact therewith when said slidable shelf means has been pulled out of said housing to said open work position;

said pivot means cooperating with a portion of said top panel means to hold said slidable shelf means at a fixed location when in said open work position and at a slight angular relationship to said top panel means so as to maintain componenents of said computer work processing system placed thereon at a relatively fixed position; and a surface portion on said slidable shelf means for supporting various components of said computer work processing system.

2. A computer work processing system as in claim 1 wherein:

said front wall portion comprises a slidable front door means mounted in said housing for permitting movement of said slidable front door means into a position within said movable computer work station so that said housing has an open front portion so that the various components of said computer work system in said housing are observable.

3. A computer work processing system as in claim 2 and further comprising:

pivot means connecting said slidable front door means to said housing when said slidable front door means has been moved to a position out of said housing for permitting pivotal movement of said slidable front door means to a position covering said open front portion; and locking means for holding said slidable and pivotal front door means in said position covering said open front portion.

4. A computer work processing system as in claim 1 wherein said support means comprises:

a plurality of U-shaped metallic channel means;

each of said U-shaped metallic channel means secured to each of said side wall portions so that said U-shaped metallic channel faces outwardly; and said U-shaped metallic channel means secured to one side wall portion being directly opposite said U-shaped metallic channel means secured to the other of said side wall portions.

5. A computer work processing system as in claim 4 and further comprising:

at least two of said U-shaped metallic channel means secured to each of said side wall portions.

6. A computer work processing system as in claim 5 and further comprising:

a metallic reinforcing means extending between and secured to at least one opposing pair of said U-shaped metallic channel means.

7. A computer work processing system as in claim 6 wherein said metallic reinforcing means comprises:

an elongated tube means having two end portions;

a leg comprising a U-shaped channel means secured by welding to each end portion and extending therefrom in the same direction and perpendicular thereto; and each of said leg secured to an opposed pair of U-shaped channel means so that all of such U-shaped channels face outwardly.

8. A computer work processing system as in claim 7 and further comprising:

each of said U-shaped metallic channel means having a top portion and a bottom portion;

at least two elongated reinforced metallic base members;

means for securing said two of said U-shaped metallic channel means on said one of said side wall portions to one of said base members; and means for securing said two of said U-shaped metallic channel means on said other of said side wall portions to the other of said base members.

9. A computer work processing system as in claim 8 and further comprising:

at least two rollers secured to each of said base members so as to provide two opposed pairs of rollers; and at least one pair of said opposed pairs of rollers being swivelly mounted.

10. A computer work processing system as in claim 9 and further comprising:

a plurality of U-shaped metallic channel cover means; and means for securing one of said U-shaped metallic channel cover means over each of said U-shaped metallic channel means so that said U-shaped channels of said U-shaped metallic channel means and said U-shaped metallic cover means face each other.

11. A computer work processing system comprising:

a generally flat top panel means for providing support means for work product materials, said panel means having a front edge portion, a back edge portion and left and right side edge portions;

a pair of laterally spaced pedestal means for supporting said top panel means a distance above a fixed generally horizontal supporting surface area;

a movable computer work station unit having a plurality of support surfaces for supporting various components of a computer work processing system;

said support surfaces located in a housing having a bottom wall portion, a top wall portion, a back wall portion, two side wall portions and a front wall portion;

support means for supporting said bottom wall portion of said movable computer work station unit at a distance above said top panel means when said movable computer work station unit is moved to a position over a portion of said top panel means including said back edge portion;

a slidable shelf means mounted in said housing for permitting movement of said slidable shelf means between a closed storage position in said housing and an open work position with a portion thereof supported on said top panel;

pivot means connecting said slidable shelf means to said housing for permitting pivotal movement of said slidable shelf means toward said top panel means and into contact therewith when said slidable shelf means has been pulled out of said housing to said open work position;

said pivot means cooperating with a portion of said top panel means to hold said slidable shelf means at a fixed location when in said open work position;

a surface portion on said slidable shelf means for supporting various components of said computer work processing system;

said front portion comprises a slidable front door means mounted in said housing for permitting movement of said slidable front door means into a position within said movable computer work station so that said housing has an open front portion so that the various components of said computer work system in said housing are observable.

pivot means connecting said slidable front door means to said housing when said slidable front door means has been moved to a position out of said housing for permitting pivotal movement of said slidable front door means to a position covering said open front portion;

locking means for holding said slidable and pivotal front door means in said position covering said open front portion;

slide guide means on said housing for guiding said slidable front door means so that the sliding movement thereof is in a plane generally parallel to said top wall portion; and said slide guide means holding said slidable door means generally parallel to said top wall portion at any location of said slidable door means between said position within said housing and said position out of said housing at which said front door means may be pivoted so that said slidable front door means provides anti-glare shade means so that said various components may be readily visible.

12. A computer work processing system as in claim 11 and further comprising:

a support panel mounted on said bottom wall portion;

a fixed shelf in said housing;

said fixed shelf secured to said support panel and one of said side wall portions;

said support panel cooperating with sections of said bottom wall portion, said one side wall portion and said back wall portion to form a compartment in said housing; and slide guide means in said compartment for supporting said slidable shelf means for sliding movement into and out of said compartment.

13. A computer work processing system as in claim 12 and further comprising:

an exposed support surface on said fixed shelf means extending between said one of said side wall portions and said support panel for supporting various components of said computer work processing system.

14. A computer work processing system as in claim 13 and further comprising:

said fixed shelf means being spaced from said section of said bottom wall portion a sufficient distance for providing a receiving space for various components of said computer work system on said surface portion of said slidable shelf means when said slidable shelf means has been moved into said compartment for storage therein.

* * * * *